US010239074B2

(12) United States Patent
Walters et al.

(10) Patent No.: US 10,239,074 B2
(45) Date of Patent: Mar. 26, 2019

(54) HOSE GUNS

(71) Applicant: EXEL INDUSTRIES SA, Epernay (FR)

(72) Inventors: George Leigh Walters, Nottingham (GB); John Francis O'Toole, Smethwick (GB)

(73) Assignee: EXEL INDUSTRIES SA, Epernay (FR)

( * ) Notice: Subject to any disclaimer, the term of this patent is extended or adjusted under 35 U.S.C. 154(b) by 60 days.

(21) Appl. No.: 15/025,973

(22) PCT Filed: Sep. 30, 2014

(86) PCT No.: PCT/GB2014/000386
§ 371 (c)(1),
(2) Date: Mar. 30, 2016

(87) PCT Pub. No.: WO2015/044633
PCT Pub. Date: Apr. 2, 2015

(65) Prior Publication Data

US 2016/0243568 A1 Aug. 25, 2016

(30) Foreign Application Priority Data

Sep. 30, 2013 (GB) ..... 1317345.5

(51) Int. Cl.
*B05B 9/01* (2006.01)
*B05B 1/12* (2006.01)
(Continued)

(52) U.S. Cl.
CPC ..... *B05B 9/01* (2013.01); *B05B 1/12* (2013.01); *B05B 1/1654* (2013.01); *B05B 15/62* (2018.02); *B05B 15/625* (2018.02); *B05B 15/652* (2018.02)

(58) Field of Classification Search
CPC . B05B 13/0431; B05B 15/065; B05B 15/067; B05B 15/069; B05B 9/01;
(Continued)

(56) References Cited

U.S. PATENT DOCUMENTS 1,125,642 A * 1/1915 Blanchard ..... A62C 31/03 239/587.5
3,940,072 A 2/1976 Ishikawa et al.
(Continued)

FOREIGN PATENT DOCUMENTS

DE 2304738 A1 8/1974
WO 2006/019231 A1 2/2006
WO 2011/075660 A1 6/2011

OTHER PUBLICATIONS

UK Search Report for corresponding application No. GB1317345.5 dated May 7, 2014.
(Continued)

*Primary Examiner* — Steven J Ganey
(74) *Attorney, Agent, or Firm* — Heslin Rothenberg Farley & Mesiti P.C.; Victor A. Cardona

(57) ABSTRACT

A hose gun has a gun body and a water outlet head for outputting water from the gun. The gun body has a user grip body portion and a second body portion which is at an angle to the user grip portion. Joint means are provided between the water outlet head and the gun body allowing the water outlet head to be moved relative to the gun body between a forward watering position and a sprinkler position in which the hose gun is positionable on a surface with the user grip body portion and second body portion acting as a base and the water outlet head directed upwardly.

28 Claims, 5 Drawing Sheets

(51) Int. Cl.

| | |
|---|---|
| ***B05B 1/16*** | (2006.01) |
| ***B05B 15/652*** | (2018.01) |
| ***B05B 15/625*** | (2018.01) |
| ***B05B 15/62*** | (2018.01) |

(58) Field of Classification Search

CPC ..... B05B 1/1654; B05B 1/12; B05B 15/061; B05B 15/063; B05B 15/066; B05B 1/18; B05B 12/002; B05B 12/025; B05B 12/02; B05B 12/2478; B05B 12/01; B05B 15/08; E03C 2001/082

USPC ... 239/587.4, 525, 526, 587.1, 587.5, 587.6, 239/587.2, 587.3

See application file for complete search history.

(56) References Cited

U.S. PATENT DOCUMENTS

| | | | | |
|---|---|---|---|---|
| 6,042,029 | A | 3/2000 | Massey | |
| 6,257,505 | B1 * | 7/2001 | Wang | B05B 9/01 239/526 |
| 6,508,415 | B2 * | 1/2003 | Wang | B05B 15/066 239/526 |
| 6,554,209 | B2 * | 4/2003 | Djordjevic | B05B 3/06 239/255 |
| 6,712,294 | B1 | 3/2004 | Wang | |
| 9,724,708 | B2 * | 8/2017 | Helmsderfer | B05B 15/063 |
| 2002/0166906 | A1 | 11/2002 | Coles | |
| 2003/0201348 | A1 | 10/2003 | Kao | |
| 2005/0139244 | A1 | 6/2005 | Boke | |
| 2006/0049283 | A1 * | 3/2006 | Lee | B05B 1/3026 239/526 |

OTHER PUBLICATIONS

International Preliminary Report on Patentability (PCT/IB373) and Written Opinion of the International Searching Authority (PCT/ISA/237) for corresponding International Application No. PCT/GB2014/000386 dated Apr. 5, 2016.

International Search Report for PCT/GB2014/000386 dated Jan. 5, 2015.

* cited by examiner

HOSE GUNS

CROSS REFERENCE TO RELATED APPLICATIONS

This application is a national stage filing under section 371 of International Application No. PCT/GB2014/000386, filed on Sep. 30, 2014, and published in English on Apr. 2, 2015, as WO 2015/044633 A1 and claims priority of Great Britain application GB 1317345.5 filed on Sep. 30, 2013, the entire disclosure of these applications being hereby incorporated herein by reference.

This invention relates to hose guns of the type used with garden and domestic hoses for watering plants, washing items, and so on.

There is a desire to provide hose guns with many different features to allow the user to use the hose gun in different circumstances and in different ways. Thus, for example, a hose gun will typically comprise a water outlet head, which is a feature head comprising a number of different outlet features for providing different watering patterns, which are useful for different circumstances.

However there are some watering functions for which traditional hose guns are not particularly useful. One of these is watering lawns where a relatively large area requires watering and a relatively large amount of water is required.

It is an aim of the present invention to provide hose guns with increased functionality.

According to one aspect of the present invention there is provided a hose gun comprising a gun body and a water outlet head for outputting water from the gun, the gun body having a user grip body portion and a second body portion which is at an angle to the user grip portion, wherein joint means are provided between the water outlet head and the gun body allowing the water outlet head to be moved relative to the gun body between a forward watering position and a sprinkler position in which the hose gun is positionable on a surface with the user grip body portion and second body portion acting as a base and the water outlet head directed upwardly.

Such arrangements allow the hose gun to be used both as a conventional hose gun and as a sprinkler. Having a grip portion which is at an angle to a second body portion helps provides a stable base when the gun is used as a sprinkler.

The water outlet head may have a water outlet axis and when the outlet head is in the forward watering position, the water outlet axis may be directed in or parallel to a plane which is occupied by the grip body portion and the second body portion, whilst when the water outlet head is in the sprinkler position, the water outlet axis may be directed away from that plane.

According to another aspect of the present invention there is provided a hose gun comprising a gun body and a water outlet head for outputting water from the gun and having a water outlet axis, the gun body having a user grip body portion and a second body portion which is at an angle to the user grip portion, wherein joint means are provided between the water outlet head and the gun body allowing the water outlet head to be moved relative to the gun body between a first position where the water outlet axis is directed in or parallel to a plane which is occupied by the grip body portion and the second body portion and a second position where the water outlet axis is directed away from that plane such that the hose gun is positionable on a surface with the user grip body portion and second body portion acting as a base and the water outlet head directed upwardly.

Such arrangements allow the hose gun to be used both as a conventional hose gun and as a sprinkler. Having a grip portion which is at an angle to a second body portion helps provides a stable base when the gun is used as a sprinkler.

The water outlet head may comprise a sprinkler feature.

The sprinkler feature may be a static outlet feature. Alternatively the sprinkler feature may be a dynamic outlet feature.

The expression upward is used to mean away from the surface and should not be considered to suggest a precisely vertical orientation.

When the water outlet head is directed upwardly for use as a sprinkler, the water outlet axis may be at right angles to the plane occupied by the grip body portion and the second body portion, but may be at other upward angles.

The joint means may be hinge means. A hinge means will be arranged to allow movement about a pivot axis. Thus a hinge means gives more control on the movement which it allows compared to some other joints such as unrestricted multi-directional ball and socket joints.

A pivot axis of the hinge means may be in or parallel to the plane occupied by the user grip body portion and the second body portion, at least when the hose gun is configured to allow movement of the feature head to the sprinkler position.

The hinge means may comprise a knuckle joint. In such a case a pivot axis of the joint may be substantially perpendicular to the axis of the outlet head. The hinge means may comprise a ball joint hinge. In such a case a pivot axis of the joint may be non-perpendicular to the axis of the outlet head.

The joint means may comprise first and second portions which are moveable relative to one another, the first portion being mounted to the gun body and the second portion being mounted to the water outlet head.

Where the joint means is hinge means the first portion of the joint means corresponds to a first portion of the hinge means and the second portion of the joint means corresponds to a second portion of the hinge means. Thus the hinge means may comprise first and second portions which are moveable relative to one another, the first portion being mounted to the gun body and the second portion being mounted to the water outlet head.

The first portion of the joint means/hinge means may be held against rotation relative to the gun body.

This can be important to ensure stability of the water outlet head when directed upwardly. If such rotation is not resisted the water outlet head may tend to rotate away from the desired position during use of the hose gun as a sprinkler.

In some embodiments the first portion of the joint means/hinge means may be fixedly held against rotation relative to the gun body.

In other embodiments the first portion of the joint means/hinge means may be releasably latched against rotation relative to the gun body.

The hose gun may comprise pivot means allowing rotation of the first portion of the hinge means about its own axis relative to the gun body to cause a pivot axis of the hinge means to rotate relative to the gun body.

This can allow movement of the water outlet head on different paths relative to the gun body and achieve different end positions when using hinge means.

The feature head may be moveable to an upward and/or downward facing position with the first portion of the hinge means in one orientation. The feature head may be moveable to a left and/or right facing position with the first position of the hinge means in another orientation.

In one set of embodiments the feature head may move in different planes with the first portion of the hinge means in different orientations. Thus with the first portion of the hinge means in one orientation, the water outlet head may be moveable in a left/right plane relative to the gun body and with the first portion of the hinge means in another orientation, the water outlet head may be moveable in an up/down plane relative to the gun body. More generally, with the first portion of the hinge means in one orientation, the water outlet head may be moveable in a first plane relative to the gun body and with the first portion of the hinge means in another orientation, the water outlet head may be moveable in a second, different, plane relative to the gun body. The planes may be at an angle to one another. The planes may be at right angles to one another.

The pivot means may comprise releasable latch means which are arranged for latching the first portion of the hinge means in at least one selected orientation relative to the gun body and arranged to allow rotation of the first portion of the hinge means relative to the gun body when the latch means are released.

The latch means may be arranged to latch the first portion of the hinge means in a first orientation relative to the gun body and to latch the first portion of the hinge means in a second orientation relative to the gun body, the two orientations being angularly separated from one another.

The latch means may be arranged such that a motion distinct from that of rotating the hinge means around its own axis relative to the gun body is required to release the latch means.

The gun may have a first configuration where the hinge means is latched in an orientation allowing left/right movement of the water outlet head relative to the gun body and a second configuration where the hinge means is latched in an orientation allowing up/down movement of the water outlet head relative to the gun body.

The hinge means may comprise an indexing arrangement comprising a resiliently mounted pin provided on one of the first and second portions of the hinge means and a series of pin receiving locations provided on the other of the first and second portions of the hinge means such that the water outlet head may be moved through a series of indexed positions relative to the gun body, each indexed position being such that the pin is received in a respective one of the receiving locations.

This can help ensure that the outlet head remains in a selected position and resist any straightening tendency that may occur in use.

An odd number of receiving locations may be provided, a central one of these corresponding to the water outlet head being in a central position relative to the gun body.

An odd number of receiving locations may be provided, a central one of these corresponding to the water outlet head being in or parallel to the plane occupied by the grip body portion and second body portion of the gun body.

This can assist the user in putting the gun into a normal forward watering or "straight" configuration.

The hose gun may comprise stop portions to limit the hinging movement of the water outlet head relative to the gun body. A first stop portion may be provided on the first hinge portion and a second stop portion may be provided on the second hinge portion.

The second body portion may extend away from both sides of a region where the grip body portion meets the second body portion.

The second body portion of the gun body may be a barrel portion.

The joint means may be mounted to the barrel portion and the grip body portion may be mounted to the barrel portion. The barrel portion may extend in a first direction from a region when the grip body portion meets the barrel portion to where the joint means is mounted on the barrel portion and the barrel portion may also extend in a second direction away from said region. This can help the barrel portion form part of a stable base when the hose gun is used as a sprinkler.

The first joint/hinge portion may be directly mounted on the gun body.

At least the first joint/hinge portion and the gun body may be of plastics material. The first joint/hinge portion may be mounted on the gun body with no metal tube component therebetween.

The first joint/hinge portion may be sonic welded to the gun body.

Embodiments of the present invention will now be described, by way of example only, and with reference to the accompanying drawings, in which.

Figure 1:
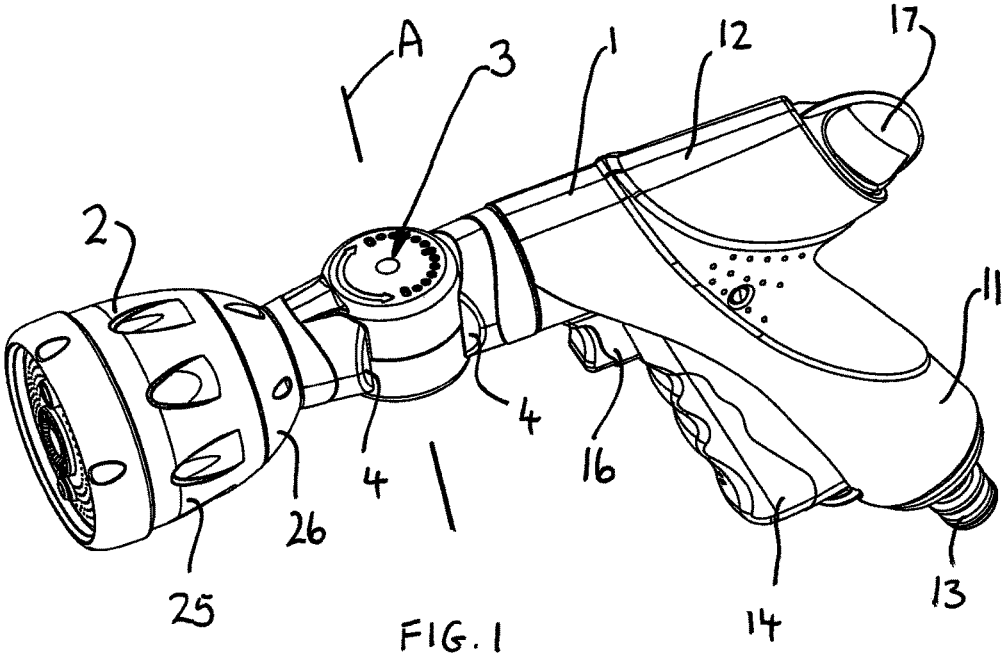
FIG. 1 shows a hose gun in a forward watering configuration.
Figure 2:
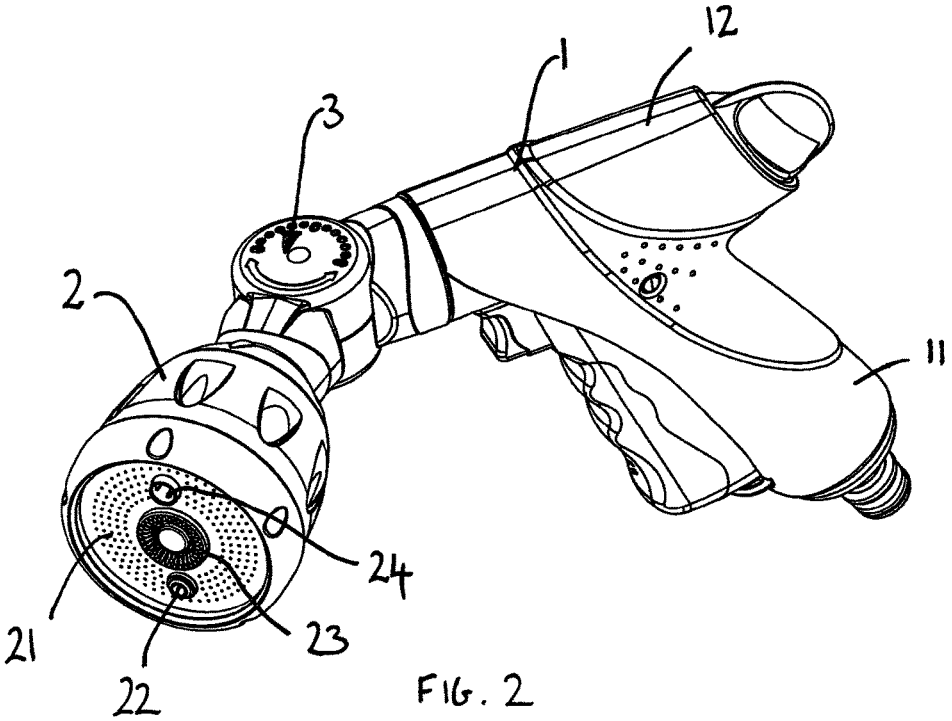
FIG. 2 shows the hose gun of FIG. 1 with a water outlet head at a different orientation.
Figure 3:
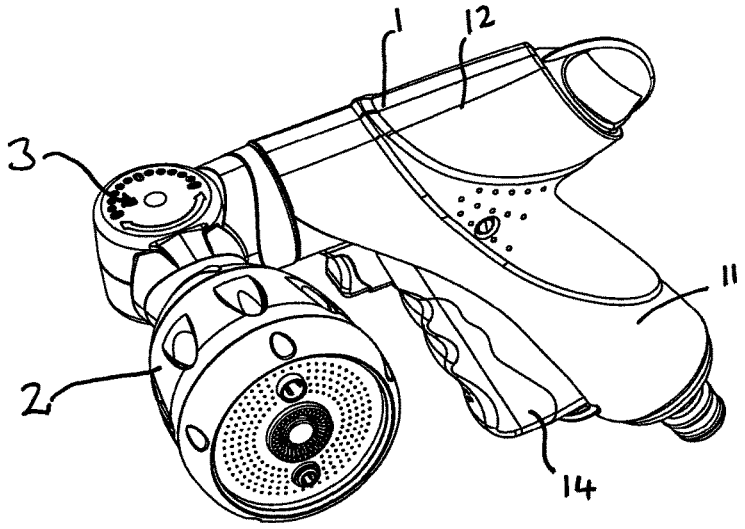
FIG. 3 shows the hose gun of FIGS. 1 and 2 with the water outlet head at yet another different orientation.
Figure 4:
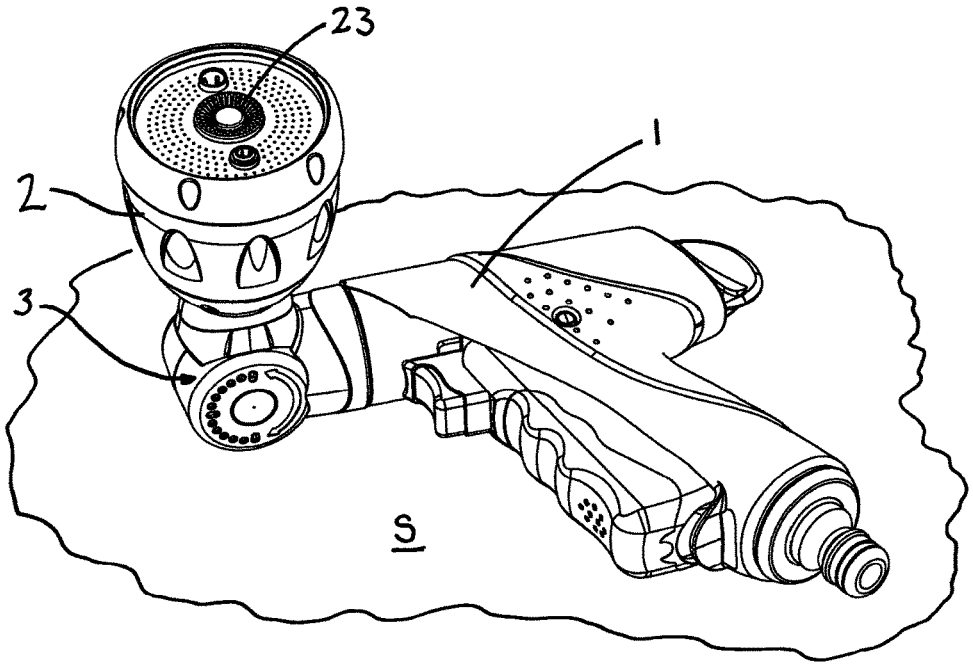
FIG. 4 shows the hose gun of FIGS. 1 to 3 with the water outlet head in the same orientation relative to the gun body as shown in FIG. 3, but with the hose gun as a whole in a different, sprinkler, orientation.
Figure 5:
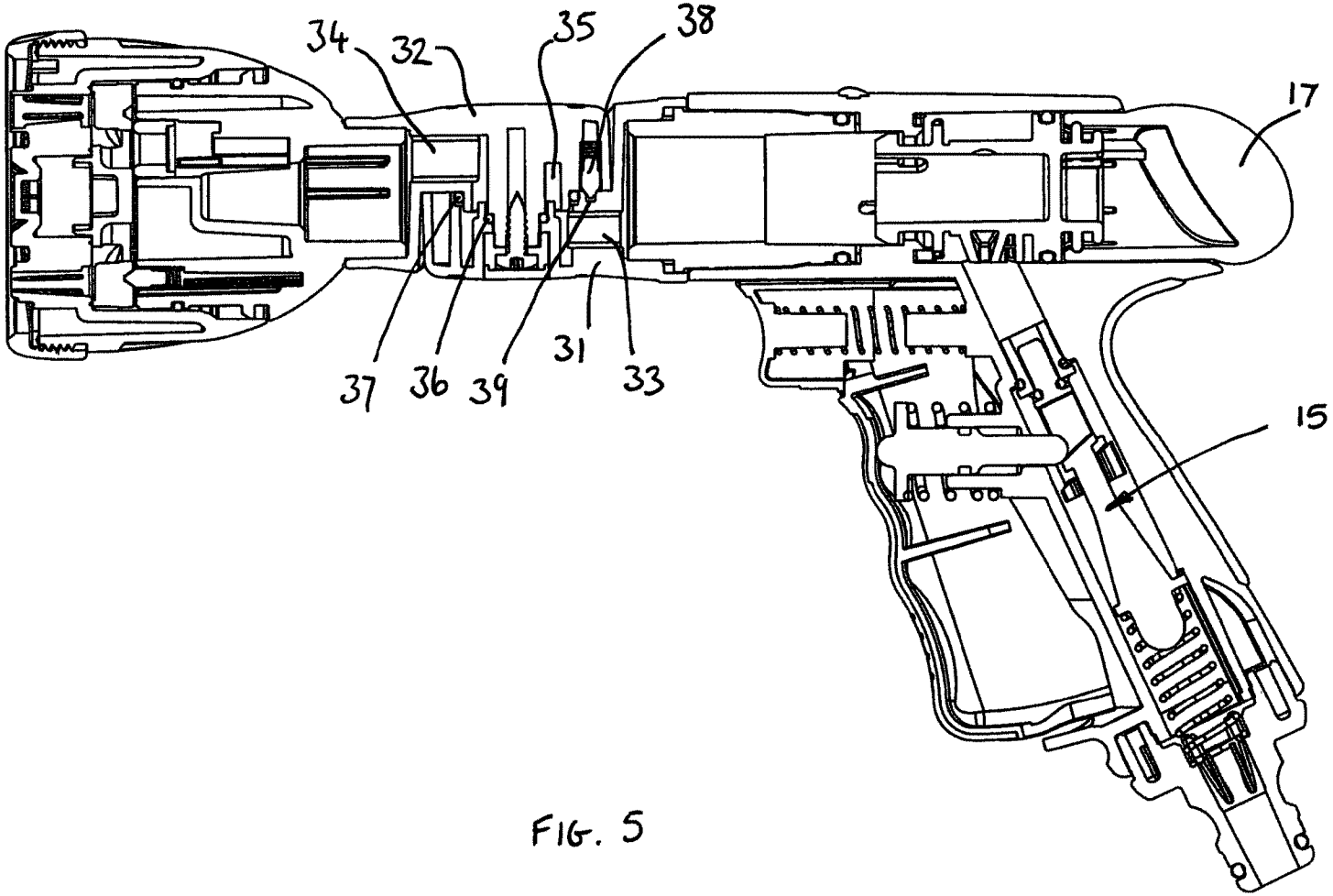
Figure 6:
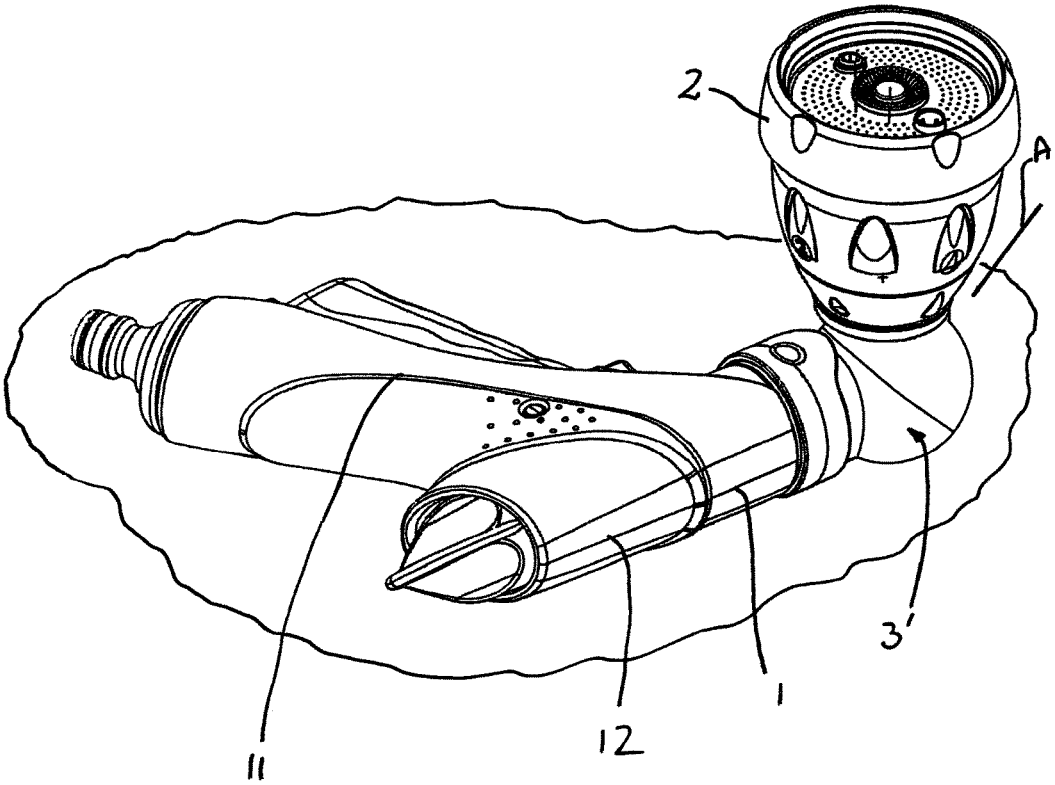
Figure 8:
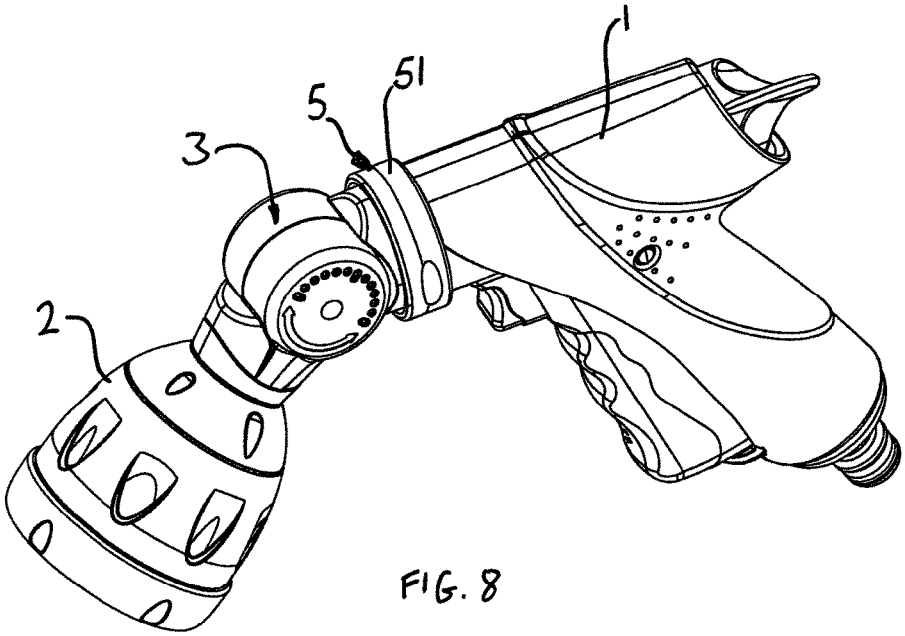
Figure 7:
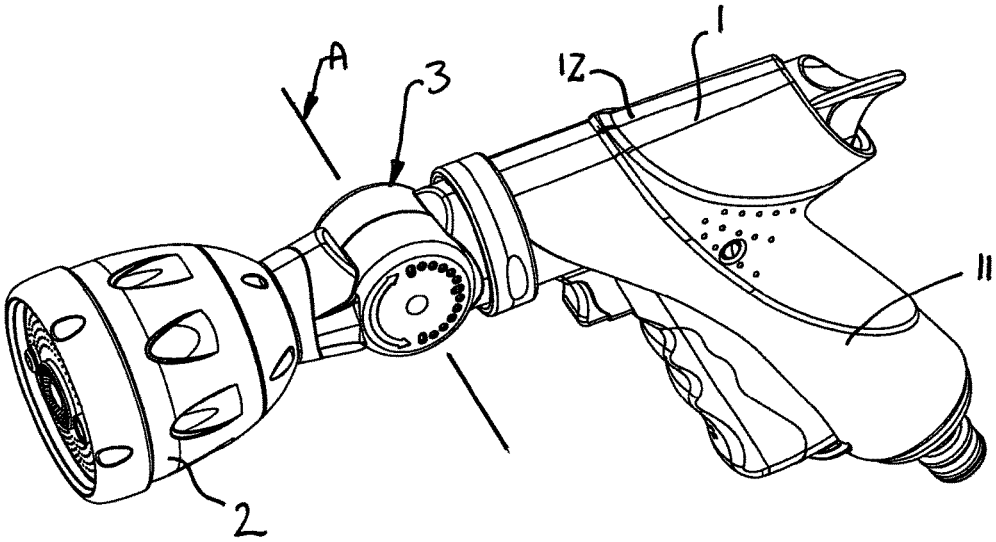

FIG. 5 schematically shows a section through the hose gun of FIGS. 1 to 4 when in the configuration shown in FIG. 1;

FIG. 6 shows an alternative hose gun which is similar to that shown in FIGS. 1 to 5 but which has a different form of hinge; and FIGS. 7 and 8 schematically show yet another hose gun which is similar to that shown in FIGS. 1 to 4 but which includes a pivot means allowing different orientations of the water outlet head to be achieved.

FIGS. 1 to 5 show a hose gun comprising a gun body 1, a water outlet head 2, and in between these two hinge means 3. In the current embodiment the hinge means 3 comprises a knuckle joint. The gun body 1 comprises a user grip portion 11 and a barrel portion 12. The user grip portion 11 joins with the barrel portion 12 part way along its length. In the present embodiment the barrel portion 12 and user grip portion 11 are moulded together as one plastics component.

A water inlet connector 13 is provided at the end of the grip portion 11 for connecting the hose gun to a hose (not shown). A water flow path is provided through the hose gun from the inlet connector 13 to the outlet head 2, as can be seen most clearly in FIG. 5.

The gun body 1 carries a trigger 14 allowing the user to control flow of water through the gun. The trigger 14 operates a valve arrangement 15 (see FIG. 5) such that when the trigger 14 is squeezed water is allowed to flow through the gun, whereas when the trigger 14 is released water flow through the gun is prevented.

A lock button 16 is provided for locking the trigger 14 in an "on" position so that water can flow through the gun without the user continuing to squeeze the trigger 14. A flow restrictor 17 is provided which allows the user to control the rate of flow through the hose gun separately from operation of the trigger 14. That is to say the flow restrictor 17 limits the maximum flow rate through the gun which is achievable even when the trigger 14 is pulled to the fully on position.

The water flow path then continues through the knuckle joint 3 to the water outlet head 2. Here a number of different water outlet features 21 to 24 are provided for providing different watering effects. Thus the water outlet head 2 can be termed a feature head 2. One of these outlet features is a sprinkler feature 23. In the current embodiment the sprinkler feature 23 is a static sprinkler feature which provides a relatively fine and diffuse water outlet effect which is suitable for sprinkler operation when the feature head 2 is appropriately orientated. A front portion 25 of the feature head is rotatable relative to a rear portion 26 to select the desired watering feature 21 to 24 for water outlet. Whichever outlet feature 21 to 24 is used the hose gun has a general water outlet axis which is generally perpendicular to the face of the outlet head in which the outlet features 21 to 24 are provided. This corresponds to the general or mean direction in which the water travels as it leaves the gun.

Besides the particular inclusion of a sprinkler feature, the internal structure and operation of the water outlet head 2 and gun body 1 are not of particular relevance to the present ideas and similar features have been described in the applicant's earlier patent applications, such as WO2005/018814. Hence these are not described in detail here.

Of more interest is the provision of the hinge means or knuckle joint 3 in the present embodiment between the hose gun body 1 and the outlet head 2. This allows the outlet head 2 to be moved from a forward watering position, as shown in FIG. 1, through intermediate positions, such as that shown in FIG. 2, to a sideways directed position as shown in FIG. 3. When the outlet head 2 is in the sideways facing position, as shown in FIG. 3, the hose gun may be laid on its side on a surface S, as shown in FIG. 4, with the water outlet head 2 directed upwardly and the barrel portion 12 and grip portion 11 of the hose gun acting as a base supporting the gun. In this orientation, with the hose gun put into a locked "on" configuration, the hose gun may be used as a sprinkler. This is particularly effective if the sprinkler feature 23 is selected at the water outlet head 2.

Note that because the user grip body portion 11 of the gun body 1 is at an angle to (i.e. not in line with) the barrel portion 12 of the gun, this leads to increased stability of the gun body 1 as a base. Further, because the grip body portion 11 meets the barrel portion 12 part way along its length, such that the barrel portion extends or projects in both directions away from the grip portion 11, again this tends to increase stability.

Note also that in the present embodiment, parts of the knuckle joint 3 also tend to contact the ground with the gun in the orientation shown in FIG. 4, further lending stability. This is aided by the gun body 1 having a generally projection-free side surface on which the gun body can rest and having the knuckle joint/hinge means arranged so that it is generally flush with the side surface of the gun body when the feature head 2 is orientated in the sideways direction as shown in FIG. 4.

Referring particularly to FIG. 5 the knuckle joint (hinge means) 3 comprises a first portion 31 which is fixedly mounted on the gun body 1, in particular sonic welded to the barrel 12 in the present embodiment, and a second portion 32 which is mounted to the feature head 2 and again in the present embodiment sonic welded thereto.

The first and second portions 31, 32 of the knuckle joint are mounted together and arranged to rotate relative to one another around a pivot axis A to provide the hinging function as illustrated in FIGS. 1 to 4. The first portion 31 includes a water inlet channel 33 and the second portion 32 includes a water outlet channel 34. These are in fluid communication with one another and remain in fluid communication with one another as the feature head 2 is moved around the pivot axis. The fluid communication is provided by an annular chamber 35 which is defined between the first and second portions 31 and 32. O-ring seals 36 and 37 are provided to give this sealed path through the knuckle joint 3.

The knuckle joint 33 comprises indexing means 38, 39 for indexing movement of the feature head 2 around the pivot axis A relative to the gun body 1. This means that the feature head 2 has a discrete number of indexed positions, specifically, indexed angular orientations relative to the gun body 1. The indexing means comprises a resiliently biased pin 38 carried in the second portion 32 of the knuckle joint 3 and a series of recesses 39 (only one of which can be seen in the drawings) provided in the first portion 31 of the knuckle joint. As the feature head 2 is moved through different angular positions, the pin 38 locates in respective ones of the recesses 39 and may ride out of a recess 39, as the user moves the feature head on towards another index position. As will be appreciated, this indexing provides some resistance to movement of the feature head 2 relative to the gun body 1 around the pivot axis A. This helps prevent movement of the feature head 2 away from a selected position and in particular tends to prevent any straightening out effect which might occur. One of the indexed positions corresponds to the forward water position, as shown in FIG. 1, where the feature head 2 is axially aligned with the gun body 1, in particular the barrel 12.

The hose gun comprises two stop portions 4 which are provided to give an accurate stop position at the end of the range of movement permitted by the knuckle joint 3. In the present embodiment the stop portions 4 are provided on the first and second portions 31, 32 of the knuckle joint 3 and can be seen apart in, for example, FIG. 1 and contacting with one another in an operative stop position in FIGS. 3 and 4.

FIG. 6 shows an alternative form of hose gun which is similar to that shown and described with reference to FIGS. 1 to 5, but which includes a different form of hinge means. Here a ball joint hinge 3' is provided as the hinge means between the feature head 2 and the gun body 1. In FIG. 6 the alternative hose gun is shown in a sprinkler configuration with the feature head 2 facing in a sideways direction relative to the gun body 1. In this embodiment the pivot axis A of the ball joint hinge 3' is at a non-perpendicular angle to both the axis of the feature head 2 and the barrel portion 12 of the gun body 1. Thus, as the feature head is moved around this axis it follows a curved path, but its end positions are the same as in the embodiment of FIGS. 1 to 5, namely a forward watering position and a sideways sprinkler position. Besides the different hinge means, the structure, functioning, and operation of the hose gun shown in FIG. 6 are the same or substantially the same as that of the hose gun shown in FIGS. 1 to 5.

FIGS. 7 and 8 show another alternative hose gun. Again this has a gun body 1 and a feature head 2 separated by hinge means 3, which again is a knuckle joint 3. In fact this hose gun has all the features of the hose gun described with reference to FIGS. 1 to 5 but includes additional pivot means. In the embodiment shown in FIGS. 1 to 5, the knuckle joint 3 is fixed in relation to the gun body 1 such that it is held against rotation relative to the gun body 1. In particular the first portion 31 of the knuckle joint 3 in the embodiment of FIG. 1 is fixedly held against rotation (around its axis/the axis of the barrel 12) relative to the gun body 1. On the other hand, the hose gun of FIGS. 7 and 8 includes latching pivot means 5 between the gun body 1 and the knuckle joint 3. The latching pivot means 5 allow the hinge means 3 and feature head 2 to be rotated about their own axis from an orientation such as that shown in FIG. 1 to an orientation as shown in FIG. 7. Thus the pivot axis A of the hinge means 3 can be rotated relative to the gun body 1. It will be noted that in an orientation such as shown in FIG. 1 the pivot axis of the hinge means is in a plane which is also occupied by the barrel portion 12 and grip portion 11 of the gun body, whereas in the orientation shown in FIG. 7 this pivot axis A is particular thereto.

Such a latchable pivot means 5 may also be provided in a hose gun with a ball joint hinge 3' of the type shown in FIG. 6. Then again rotation of the hinge means 3 and feature head 2 about their own axis allows rotation of the pivot axis about which the hinge operates.

The net effect of this in both cases is that it allows a gun with a latchable pivot means of the type shown in FIGS. 7 and 8 to be operated in a mode where the water outlet head 2 can be moved side to side relative to the gun body 1 in the way shown in FIGS. 1 to 4 and also allows the feature head 2 to be moved in an up and down direction relative to the gun body 3 as illustrated in FIGS. 7 and 8.

In the current embodiment the latching pivot means 5 allows rotation of the hinge means 3 about its axis (so rotating the pivot axis of the hinge means) by 90 degrees between the orientation shown in FIG. 7 and one such as shown in FIG. 1. Further the latching pivot means 5 latches or locks the hinge means 3 in whichever one of these two orientations is selected. Thus once, for example, the hinge means 3 is put in the orientation shown in FIG. 7, twisting of the feature head 2 will not cause the hinge means 3 to rotate relative to the gun body 1 as the latch in the latching pivot means 5 will resist this. Furthermore when the hinge 3 is in an orientation like that shown in FIG. 1, twisting of the feature head 2 will not cause the hinge 3 to rotate relative to the gun body 1 as again the latching pivot means 5 will serve to prevent this.

In the present embodiment, the latchable pivot means 5 includes a latching collar 51 which is moveable relative to the gun body 1 away from the remainder of the latching pivot means 5 to release the latch. When a user desires to move the hinge from the orientation shown in FIG. 7 towards an orientation such as that shown in FIG. 1 (or vice versa), the user moves the collar 51 away from the hinge 3 to release the pivot means 5. Then the feature head 2 and hinge 3 may be rotated around their axis relative to the gun body 1. When the hinge 3 is in either the orientation shown in FIG. 7 or an orientation like that shown in FIG. 1, the latching collar 51 may be released to latch the hinge 3 in position. In the current embodiment it is not possible to latch the hinge 3 in any intermediate orientations between that shown in FIG. 1 and that shown in FIG. 7. Thus the latchable means 5 provides the ability to rotate the hinge means 3 by 90 degrees around its own axis and correspondingly move the pivot axis of the hinge means 3 through 90 degrees.

More generally the latching pivot means 5 may allow latching of the hinge means 3 in a selected one of at least two available latching orientations.

The invention claimed is:

1. A hose gun comprising:

a gun body and a water outlet head for outputting water from the gun, the gun body having a user grip body portion and a second body portion which is at an angle to the user grip portion, wherein joint means are provided between the water outlet head and the gun body allowing the water outlet head to be moved relative to the gun body between a forward watering position and a sprinkler position in which the hose gun is positionable on a surface with the user grip body portion and the second body portion acting as a base and the water outlet head directed upwardly; and wherein the gun body has a generally projection free side surface on which the gun body can rest and having joint means arranged so that said joint means is generally flush with the side surface of the gun body when the water outlet head is in said sprinkler position.

2. A hose gun according to claim 1 in which the joint means are hinge means.

3. A hose gun according to claim 2 in which a pivot axis of the hinge means is in or parallel to a plane occupied by the user grip body portion and the second body portion, at least when the hose gun is configured to allow movement of the feature head to the sprinkler position.

4. A hose gun according to claim 1, in which the joint means comprises first and second portions which are moveable relative to one another, the first portion being mounted to the gun body and the second portion being mounted to the water outlet head.

5. A hose gun according to claim 4 in which the first portion of the joint means is held against rotation relative to the gun body.

6. A hose gun according to claim 5 in which the first portion of the joint means is fixedly held against rotation relative to the gun body.

7. A hose gun according to claim 5 in which the first portion of the joint means is releasably latched against rotation relative to the gun body.

8. A hose gun according to claim 7 in which the joint means are hinge means and the hose gun comprises pivot means allowing rotation of the first portion of the hinge means about its own axis relative to the gun body to cause a pivot axis of the hinge means to rotate relative to the gun body, wherein the pivot means comprises releasable latch means which are arranged for latching the first portion of the hinge means in at least one selected orientation relative to the gun body and arranged to allow rotation of the first portion of the hinge means relative to the gun body when the latch means are released.

9. A hose gun according to claim 8 in which the latch means are arranged to latch the first portion of the hinge means in a first orientation relative to the gun body and to latch the first portion of the hinge means in a second orientation relative to the gun body, the two orientations being angularly separated from one another.

10. A hose gun according to claim 8 in which the latch means are arranged such that a motion distinct from that of rotating the hinge means 15 around its own axis relative to the gun body is required to release the latch means.

11. A hose gun according to claim 8 in which the hose gun has a first configuration where the hinge means is latched in an orientation allowing left/right movement of the water outlet head relative to the gun body and a second configuration where the hinge means is latched in an orientation allowing up/down movement of the water outlet head relative to the gun body.

12. A hose gun according to claim 1 in which the hinge means comprises an indexing arrangement comprising a resiliently mounted pin provided on one of the first and second portions of the hinge means and a series of pin receiving locations provided on the other of the first and second portions of the hinge means such that the water outlet head may be moved through a series of indexed positions relative to the gun body, each indexed position being such that the pin is received in a respective one of the receiving locations.

13. A hose gun according to claim 12 in which an odd number of receiving locations are provided, a central one of these corresponding to the water outlet head being in a central position relative to the gun body.

14. A hose gun according to claim 1 in which the second body portion extends away from both sides of a region where the grip body portion meets the second body portion.

15. A hose gun according to claim 1 in which the second body portion of the gun body is a barrel portion, with the joint means mounted to the barrel portion and the grip body portion mounted to the barrel portion.

16. A hose gun according to claim 1 in which the water outlet head comprises at least one water outlet feature for providing a respective watering effect wherein said at least one water outlet feature comprises a sprinkler feature.

17. A hose gun according to claim 1 wherein the hose gun is a garden watering hose gun.

18. A hose gun according to claim 1 further comprising a trigger allowing a user to control a flow of water through the gun and a lock button for locking the trigger in an on position.

19. A hose gun according to claim 18 further comprising a user operable flow restrictor for controlling a rate of the water flow through the hose gun separately from an operation of the trigger such that when the trigger is locked in said on position the rate of the water flow through the hose gun is controllable by the user operable flow restrictor.

20. A hose gun comprising:

a gun body and a water outlet head for outputting water from the gun, the gun body having a user grip body portion and a second body portion which is at an angle to the user grip portion, wherein joint means are provided between the water outlet head and the gun body allowing the water outlet head to be moved relative to the gun body between a forward watering position and a sprinkler position in which the hose gun is positionable on a surface with the user grip body portion and second body portion acting as a base and the water outlet head directed upwardly, and wherein the joint means comprises first and second portions which are moveable relative to one another, the first portion being mounted to the gun body and the second portion being mounted to the water outlet head, with the first portion of the joint means being releasably latched against rotation relative to the gun body.

21. A hose gun according to claim 20 wherein the joint means are hinge means and the hose gun comprises pivot means allowing rotation of the first portion of the hinge means about its own axis relative to the gun body to cause a pivot axis of the hinge means to rotate relative to the gun body, wherein the pivot means comprises releasable latch means which are arranged for latching the first portion of the hinge means in at least one selected orientation relative to the gun body and arranged to allow rotation of the first portion of the hinge means relative to the gun body when the latch means are released.

22. A hose gun according to claim 21 wherein the latch means are arranged to latch the first portion of the hinge means in a first orientation relative to the gun body and to latch the first portion of the hinge means in a second orientation relative to the gun body, the two orientations being angularly separated from one another.

23. A hose gun according to claim 21 wherein the latch means are arranged such that a motion distinct from that of rotating the hinge means around its own axis relative to the gun body is required to release the latch means.

24. A hose gun according to claim 21 wherein the hose gun has a first configuration where the hinge means is latched in an orientation allowing left/right movement of the water outlet head relative to the gun body and a second configuration where the hinge means is latched in an orientation allowing up/down movement of the water outlet head relative to the gun body.

25. A hose gun comprising:

a gun body and a water outlet head for outputting water from the gun, the gun body having a user grip body portion and a second body portion which is at an angle to the user grip portion, wherein hinge means are provided between the water outlet head and the gun body allowing the water outlet head to be moved relative to the gun body between a forward watering position and a sprinkler position in which the hose gun is positionable on a surface with the user grip body portion and second body portion acting as a base and the water outlet head directed upwardly, and wherein the hinge means comprises an indexing arrangement comprising a resiliently mounted pin provided on one of the first and second portions of the hinge means and a series of pin receiving locations provided on the other of the first and second portions of the hinge means such that the water outlet head may be moved through a series of indexed positions relative to the gun body, each indexed position being such that the pin is received in a respective one of the receiving locations.

26. A hose gun according to claim 25 wherein an odd number of receiving locations are provided, a central one of these corresponding to the water outlet head being in a central position relative to the gun body.

27. A hose gun comprising:

a gun body and a water outlet head for outputting water from the gun, the gun body having a user grip body portion and a second body portion which is at an angle to the user grip portion, wherein joint means are provided between the water outlet head and the gun body allowing the water outlet head to be moved relative to the gun body between a forward watering position and a sprinkler position in which the hose gun is positionable on a surface with the user grip body portion and the second body portion acting as a base and the water outlet head directed upwardly; and in which the second body portion of the gun body is a barrel portion, with the joint means mounted to the barrel portion and the grip body portion mounted to the barrel portion.

28. A hose gun comprising:

a gun body and a water outlet head for outputting water from the gun, the gun body having a user grip body portion and a second body portion which is at an angle to the user grip portion, wherein joint means are provided between the water outlet head and the gun body allowing the water outlet head to be moved relative to the gun body between a forward watering position and a sprinkler position in which the hose gun is positionable on a surface with the user grip body portion and the second body portion acting as a base and the water outlet head directed upwardly; and further comprising a trigger allowing a user to control a flow of water through the gun and a lock button for locking the trigger in an on position.

* * * * *